US006006954A

United States Patent [19]

Warby

[11] Patent Number: 6,006,954

[45] Date of Patent: Dec. 28, 1999

[54] METERING VALVE

[75] Inventor: Richard John Warby, Wisbech, United Kingdom

[73] Assignee: Bespak plc, Norfolk, United Kingdom

[21] Appl. No.: 09/074,466

[22] Filed: May 8, 1998

[30] Foreign Application Priority Data

Jun. 10, 1997 [GB] United Kingdom ..... 9712054

[51] Int. Cl.[6] ..... B65D 83/00

[52] U.S. Cl. ..... 222/342; 222/148; 222/402.2

[58] Field of Search ..... 222/148, 342, 222/402.2, 402.24

[56] References Cited

U.S. PATENT DOCUMENTS 4,362,257 12/1982 Shay .

*Primary Examiner*—Kevin Shaver
*Assistant Examiner*—Keats Quinalty
*Attorney, Agent, or Firm*—Smith, Gambrell & Russell, LLP

[57] ABSTRACT

A metering valve for use with a pressurized dispensing container includes a valve stem (1) co-axially slidable within a valve member (2) defining an annular metering chamber (13). The valve stem (1) is provided with a wiper (30) extending radially therefrom to contact an inner surface of the valve member (2) such that, in use, as the valve stem (1) slides axially within the valve member (2), the wiper (30) scrapes the inner surface to remove solid matter disposed thereon.

13 Claims, 3 Drawing Sheets

METERING VALVE

This invention relates to improvements in metering valves for pressurised dispensing containers and, in particular, to a means for removing solids deposited in the metering chambers of such valves.

Pressurised dispensing containers are typically used to dispense products in aerosol form using a propellant which is volatile at normal temperature and pressure, the product to be dispensed being mixed with liquid propellant which remains in liquid phase by virtue of excess vapour pressure within the container. Metering valves are utilised to dispense measured volumes of this liquid and comprise a metering chamber with inlet and outlet valves controlled by displacement of a valve stem which defines an outlet duct. The product to be dispensed may be in the form of a particulate wherein the particles of solid product are held in suspension in the liquid propellant.

Operation of the metering valve requires the chamber to be filled via the inlet valve, the inlet valve is then closed and the outlet valve opened such that the contents are expelled by boiling off propellant in response to the chamber being vented to atmospheric pressure.

A problem with the use of metering valves with liquid propellant having a particulate product suspended therein is the deposition of the solid product on the inner surfaces of the metering chamber after a number of operation cycles and/or storage. This can lead to reduced efficiency of operation of the valve since deposition of the product reduces the amount of active drug available to be dispensed (due to the active drug remaining on the surface of the chamber). Deposition can also lead to an increased risk of contamination of the dispensed product due to the solids deposited in the metering chamber. Prior art devices rely on the container and attached valve being shaken in an attempt to dislodge the deposited particles as a result of the movement of the liquid propellant and product mixture. However, whilst this remedy is effective within the body of the container itself, it is not effective for particles deposited on the inner surfaces of the metering chamber. As the size of the chamber is significantly smaller, the restricted flow of fluid in the metering chamber (caused by the tortuosity of the flow path through the chamber) means that the fluid in the metering chamber does not move with enough energy to adequately remove the deposited particles.

The object of the present invention is to provide a means for removing solids that may become deposited on the inner surfaces of the metering chamber.

Therefore the present invention provides a metering valve for use with a pressurised dispensing container for dispensing a product, the metering valve comprising a valve stem co-axially slidable within a valve member defining an annular metering chamber, wherein the valve stem is provided with wiper means extending radially therefrom to contact an inner surface of the valve member such that, in use, as the valve stem slides axially within the valve member the wiper means scrapes the inner surface to thereby remove solid matter deposited thereon.

The description of the wiper means as having a scraping action is not meant to imply that the material of the valve member is partially removed but that deposits on the surface of the valve member are scraped off the surface of the valve member.

Preferably the wiper means comprises an annular disc having apertures therein, to allow passage of the product from one side of the wiper means to the other.

Preferably the apertures are radial slots extending from a perimeter of the wiper means.

Preferably the wiper means extends from an outwardly extending flange of the valve stem.

It is desired that the perimeter of the wiper means forms an interference fit with the inner surface of the valve member.

Preferably at least the perimeter of the wiper means is flexible and is deformed against the inner surface of the valve member.

Alternatively the perimeter of the wiper means forms a flush fit with the inner surface of the valve member.

In one embodiment the wiper means comprises one or more angled projections.

In another embodiment the wiper means comprises two or more layers of projections; each layer having apertures therein; the apertures in each layer being rotationally displaced relative to one another.

Preferably the wiper means is formed integrally with the valve stem.

This is advantageous in that the manufacturing cost of the present invention is reduced.

Preferably the wiper means is of plastics material.

Preferably the wiper means is of an acetal or polyester material.

Plastics such as acetal and polyester are suitable materials for the wiper of the present invention since they are both flexible and resistant to wear. They can also be easily formed by known manufacturing methods to produce a clean, well defined edge.

Preferably the valve further comprises a helical spring biasing the valve stem to its rest position, wherein on depression of the valve stem to a dispensing position the effect of the spring causes the wiper means to rotate about a central vertical axis of the valve stem.

The present invention will now be described, by way of example only, with reference to the accompanying drawings, of which:

Figure 1:
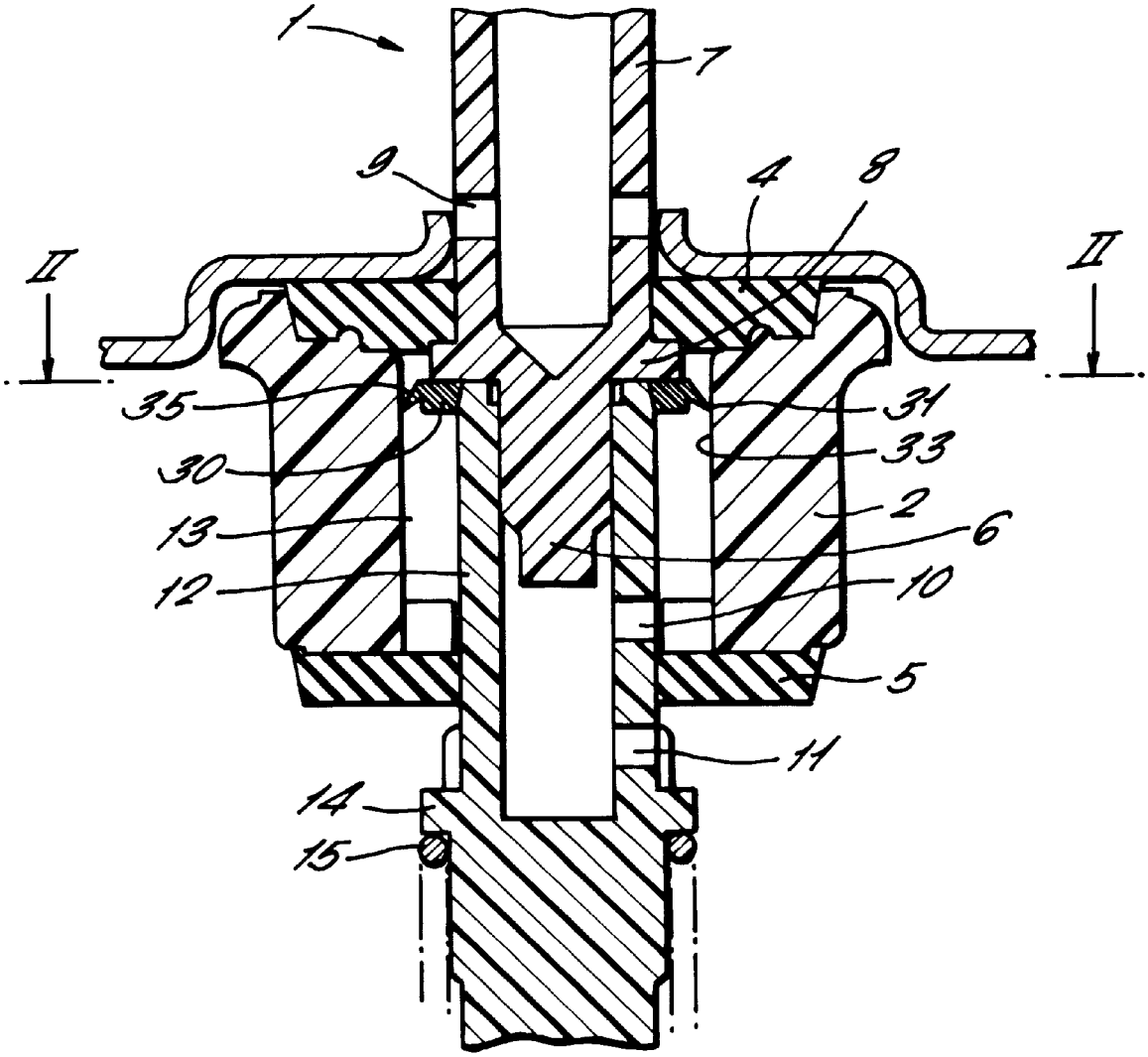
FIG. 1 is a cross-section of the metering valve of the present invention.

The metering valve of FIG. 1 comprises a valve stem 1 which is movable axially relative to and within a valve member 2 defining a metering chamber 13. The valve member 2 is attached to a container (not shown), containing a product to be dispensed, and the valve is attached by means of a ferrule which is crimped to an open mouth of the container.

Annular sliding seals are provided, such that an outer seal 4 and an inner seal 5, preferably of elastomeric material, extend radially between the valve stem 1 and the valve member 2 and the valve stem 1 is slidable within the seals 4, 5.

(Throughout the description, unless otherwise indicated, the terms inner and outer indicate relative positions along the axis of the metering valve such that "inner" implies proximal to the container and "outer" implies distal with respect of the container).

The outer seal 4 is radially compressed between the valve member 2 and the valve stem 1 so as to provide positive sealing contact, the compression being achieved by dimensioning the outer seal 4 such that there is an interference fit on the valve stem 1 or by axially compressing the outer seal by the crimping of the ferrule which secures together the container, the valve stem 1, the valve member 2 and the outer seal 4 during assembly.

An upper end portion 7 of the valve stem 1 is tubular having an internal axial duct closed at an inner end. A discharge port 9 is defined in the upper end portion 7 at a location which projects above the ferrule when the valve stem 1 is in its extended position (see FIG. 1) the port 9 extending radially into the valve stem 1 into communication with the internal axial duct of the upper end portion 7. The upper end portion 7 comprises an external radially projecting flange 8 and an axially extending projection 6.

A lower portion 12 of the valve stem 1 comprises a tubular portion that is engagable with the axially extending projection 6 to form a liquid-tight seal there between. The lower portion 12 further comprises a pair of axially spaced radial ports 10 and 11, which are interconnected through a central cavity within the lower portion 12.

The annular metering chamber 13 is normally sealed from the atmosphere by the outer seal 4 when the valve stem 1 is in its extended position (as shown in FIG. 1). In the configuration shown in FIG. 1, the radial ports 10 and 11, together with the central cavity enable the metering chamber 13 to communicate with the interior of the container to enable filling of the metering chamber 13 with the fluid product to be dispensed.

Upon depression of the valve stem 1 relative to the valve member 2, the radial port 10 is sealed by the inner seal 5 so that the metering chamber 13 is isolated from the contents of the pressurised container. Upon further depression of the valve stem 1, the discharge port 9 moves into a position in which it communicates with the metering chamber 13 thereby providing an outlet path, via the discharge port 9 and internal axial duct of the upper portion 7 of the valve stem 1, such that the pressurised material within the metering chamber 13 can be discharged to the atmosphere. This is effected by virtue of the rapid expansion of volatile propellant on being exposed to atmospheric pressure. Upon returning the valve stem 1 to the extended position as shown in FIG. 1, the metering chamber 13 becomes recharged in readiness for further dispensing operations.

A return spring 15 extends in compression between a valve housing (not shown) of the container and a second flange 14 of the valve stem 1, the bias provided by the spring 15 urging the valve stem 1 into its extended position with the flange 8 in sealing contact with the outer seal 4.

A problem associated with prior art arrangements of metering valves for pressurised dispensers is that the side walls of the metering chambers 13 can become covered by a deposition of solids from the product to be dispensed. This may be caused by a number of factors including incomplete emptying of the metering chamber 13 during operation of the valve, the characteristics of the product itself which can have a tendency to adhere to surfaces it contacts and the characteristics of the plastic used to manufacture the chamber, i.e. the plastic attracts the drug to its surface. The deposition of solids is especially relevant where the product consists of a particulate substance held in suspension in the liquid propellant. When the valve stem 1 is operated, the liquid propellant in the metering chamber 13 boils off through the outlet duct. However, a small proportion of the particulate substance can be left behind on the inner surfaces of the metering chamber 13 reducing the amount of active drug emitted per actuation.

This problem is overcome in accordance with the present invention by the inclusion of a wiper 30 located on the valve stem 1 within the metering chamber 13. The wiper 30 is preferably annular and has apertures therein to allow the product to be dispensed to flow past the wiper 30 within the metering chamber 13. The wiper 30 may alternatively extend from, or be moulded integrally with, the flange 8. However, the wiper 30 may be positioned on the valve stem 1 at a position other than on the flange 8. The perimeter 31 of the wiper 30 is in contact with the inner surface 33 of the valve member 2, i.e., the side wall of the metering chamber 13. The wiper 30 or the perimeter 31 of the wiper 30 may be flexible, forming an interference fit with the inner surface 33 of the valve member 2 by deforming against the said inner surface 33 when assembled therewith. Alternatively, the wiper 30 or the perimeter 31 thereof is more rigid, the wiper 30 being dimensioned to provide a flush fit with the inner surface 33 of the valve member 2.

Preferably, the wiper 30 is manufactured from the same material as the valve stem 1. This material may be acetal or polyester or a similar material having at least limited flexibility and resistance to abrasion.

In use, the valve stem 1 is depressed and the wiper 30 moves axially relative to the valve member 2 and, therefore, the metering chamber 13. As the perimeter 31 of the wiper 30 is in contact with the inner surface of the valve member 2, which surface constitutes the side wall of the metering chamber 13, the resulting action of the wiper 30 is to dislodge any solid particles of product that have been deposited on the inner surface 33. These particles are then free to be dispensed in the normal way along with the remainder of the metered dose of liquid propellant and product. When the valve stem 1 is released, the valve stem 1 returns to its extended position due to the bias of the return spring 15. During the return stroke, the perimeter 31 of the wiper 30 also remains in contact with the inner surface 33 of the valve member 2. The construction of the wiper 30 is such that the whole or at least a part of the perimeter 31 of the wiper 30 remains in contact with the inner surface 33 throughout the downward and return strokes of the valve stem 1. An advantage of the flexible form of the wiper 30 is that the perimeter 31 remains in contact with the internal surface 33 even if there exist slight variations in the internal diameter of the valve member 2.

In one embodiment of the invention, as shown in FIG. 1, the wiper 30 is in the form of an angled annular projection 35 adjacent the valve stem flange 8. The projection 35 is positioned to point downwards as shown in FIG. 1 and has apertures located in the body of the wiper 30 to allow the passage of product from one side of the wiper 30 to the other. The wiper 30 moves more easily in the upward direction, as is the case during the return stroke of the valve stem 1, than in the downward direction, as in the depression of the valve stem 1 to effect dispensing of the product. This is advantageous since the user of the apparatus can supply more force in depressing the valve stem 1 that the return spring can exert during the return stroke. Hence the valve stem is less likely to jam during the return stroke. The result of this is that the scraping action of the wiper 30 is stronger during the dispensing stroke of the valve stem 1. This is advantageous in that any particles deposited during periods of storage of the valve are more efficiently removed, preventing the long term build up of solid matter. Thus the consistent operation and efficiency of the valve is maintained over many operation cycles.

However, the present invention is not limited to a wiper 30 having the backward facing projection 35 in the orientation shown in FIG. 1 but it may also have the projection 35 orientated pointing upwardly, i.e., towards the outer seal 4.

Figure 2:
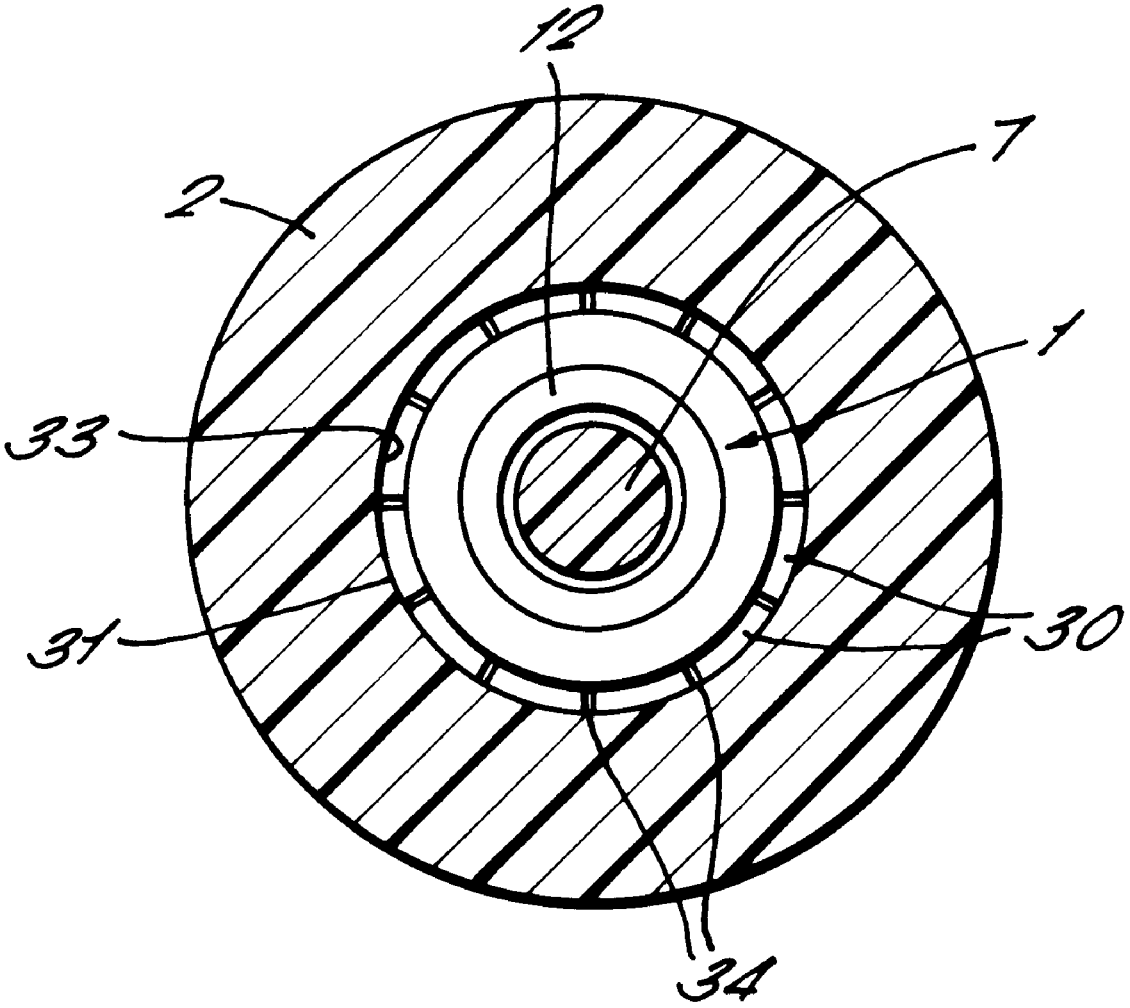
FIG. 2 is a cross-sectioned plan view of the valve stem on the line II—II of FIG. 1.

In FIG. 2, a preferred embodiment of the wiper 30 is illustrated. In this embodiment, the wiper 30 is shown as being non-continuous, the apertures being provided by slots 34 at spaced intervals around the wiper 30 extending radially inwards from the perimeter 31. The purpose of the slots 34 is to allow the unimpeded flow of product and liquid propellant axially within the metering chamber 13 during the stroke of the valve stem 1. Thus, when the valve stem 1 is depressed and the wiper 30 moves downwardly towards the inner seal 5, the liquid propellant and product is free to move from the inner end of the metering chamber 13 through the slots 34 to the outer end of the metering chamber 13.

The slots 34 may be of varying dimensions depending on the nature and viscosity of the propellant and product mixture to be dispensed. The number of slots 34 may also be varied without departing from the scope of the present invention. Furthermore, the slots may be replaced by other shaped apertures located in other areas of the wiper 30. For instance, the wiper 30 may have a continuous perimeter 31 in contact with the valve member 2, with apertures located remote from the perimeter 31.

When a helical return spring 15 is used, each operation of the valve stem 1 causes the valve stem 1 to tend to rotate about a central vertical axis in an incremental fashion. Thus, the wiper 30 also tends to rotate about the central vertical axis, so that at each depression of the valve stem 1 a different swath of the inner surface 33 is scraped clean. This leads to the whole of the inner surface of the chamber body being scraped clean of deposited particles over a small number of operations of the valve stem 1.

Figure 3:
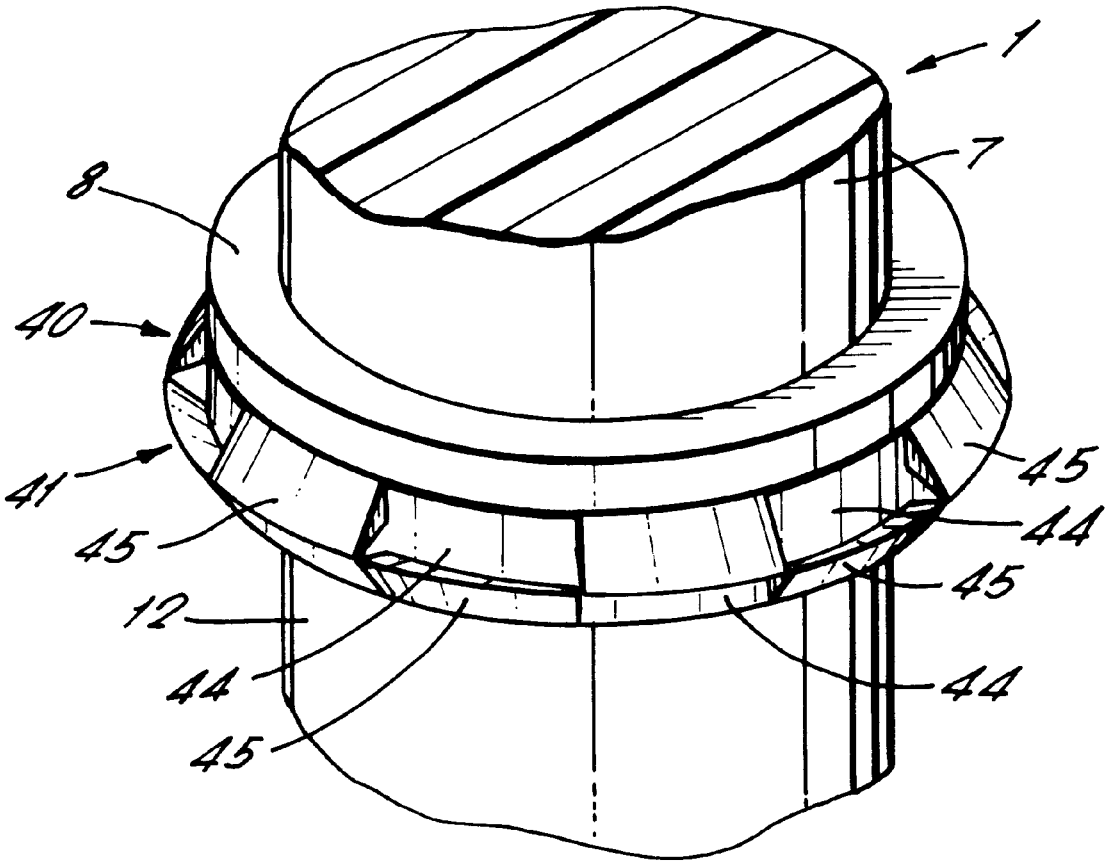
FIG. 3 is a perspective view of a part of the valve stem of FIG. 1 illustrating another embodiment of wiper.

In another embodiment of the present invention (as shown in FIG. 3) the wiper 30 depends from flange 8 and comprises two layers 40, 41 of angled projections 45 spaced apart by slots 44 around the circumference of the wiper 30. However, slots 44 on a first layer 40 are rotationally displaced relative to the slots 44 on a second layer 41 such that when viewed in plan the perimeter 31 of the wiper 30 is formed by the alternating projections 45 of the first and second layers 40, 41. With this embodiment a single movement of the wiper 30 can clean the entire circumference of the internal surface 33 of the valve body 2 since those portions of the internal surface 33 which are not in contact with a projection 45 of the first layer 40 are in contact with a projection 45 of the second layer 41. Fluid product and liquid propellant are still free to move from one side of the wiper 30 to the other through the slots 44 which interconnect across the layers 40, 41 to provide a continuous flow path. An advantage of this embodiment of wiper 30 is that there is no requirement for the wiper 30 to rotate about the central vertical axis of the valve stem 1 in order for the whole of the internal surface 33 to be scraped clean. Also the entire internal surface 33 is scraped at each depression of the valve stem 1.

The layers of projections may have the projections on each layer pointing in the same direction, either upwardly or downwardly, or may be orientated in differing directions, one layer pointing upwardly and one downwardly. Alternatively a single layer may have a mixture of upwardly and downwardly pointing projections.

The wiper 30 may comprise more than two layers of projections 45.

The use of a wiper as disclosed in the present invention is not restricted to the particular embodiment of the metering valve described, but may be advantageously used in any metering valve where liquid propellant and product are temporarily stored in an annular metering chamber through which an axially displaceable valve stem passes. For instance, the wiper 30 may depend directly from the valve stem 1 and not from the flange 8.

I claim:

1. A metering valve for use with a pressurized dispensing container for dispensing a product, the metering valve comprising a valve stem co-axially slidable within a valve member defining an annular metering chamber, wherein the valve stem is provided with wiper means extending radially therefrom to contact an inner surface of the valve member such that, in use, as the valve stem slides axially within the valve member the wiper means scrapes the inner surface to thereby remove solid matter deposited thereon.

2. A metering valve as claimed in claim 1, wherein the wiper means comprises an annular disc having apertures therein, to allow passage of the product from one side of the wiper means to the other.

3. A metering valve as claimed in claim 2, wherein the apertures are radial slots extending from a perimeter of the wiper means.

4. A metering valve as claimed in claim 1, wherein the wiper means extends from an outwardly extending flange of the valve stem.

5. A metering valve as claimed in claim 1, wherein the perimeter of the wiper means forms an interference fit with the inner surface of the valve member.

6. A metering valve as claimed in claim 5, wherein at least the perimeter of the wiper means is flexible and is deformed against the inner surface of the valve member.

7. A metering valve as claimed in claim 1, wherein the perimeter of the wiper means forms a flush fit with the inner surface of the valve member.

8. A metering valve as claimed in claim 1, wherein the wiper means comprises one or more angled projections.

9. A metering valve as claimed in claim 1, wherein the wiper means comprises two or more layers of projections; each layer having apertures therein; the apertures in each layer being rotationally displaced relative to one another.

10. A metering valve as claimed in claim 1, wherein the wiper means is formed integrally with the valve stem.

11. A metering valve as claimed in claim 1, wherein the wiper means is of plastics material.

12. A metering valve as claimed in claim 1, wherein the wiper means is of an acetal or polyester material.

13. A metering valve as claimed in claim 1, wherein the valve further comprises a helical spring biasing the valve stem to its rest position, wherein on depression of the valve stem to a dispensing position the effect of the spring causes the wiper means to rotate about a central vertical axis of the valve stem.

* * * * *